US008031116B1

(12) United States Patent
Lee et al.

(10) Patent No.: US 8,031,116 B1
(45) Date of Patent: Oct. 4, 2011

(54) MICROWAVE ANTENNA SYSTEM

(75) Inventors: Jae Seung Lee, Ann Arbor, MI (US); Paul Donald Schmalenberg, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 12/910,302

(22) Filed: Oct. 22, 2010

(51) Int. Cl.
*H01Q 3/26* (2006.01)

(52) U.S. Cl. ..... 342/374; 342/372; 342/375

(58) Field of Classification Search ..... 342/368, 342/372, 374, 375, 81, 377
See application file for complete search history.

(56) References Cited

U.S. PATENT DOCUMENTS 4,045,800 A 8/1977 Tang et al.
4,063,250 A * 12/1977 Fenwick ..... 343/844
4,649,393 A 3/1987 Rittenbach
5,430,452 A 7/1995 DuBois
6,037,910 A 3/2000 Solbach et al.
7,420,507 B2 * 9/2008 Thomas et al. ..... 342/368

* cited by examiner

*Primary Examiner* — Thomas Tarcza
*Assistant Examiner* — Cassie Galt
(74) *Attorney, Agent, or Firm* — Gifford, Krass, Sprinkle, Anderson & Citkowski, P.C.

(57) ABSTRACT

A microwave antenna system having a plurality of antenna elements arranged in an array having two spaced ends. A phase shifter is electrically connected to a first group of at least two adjacent antenna elements at one end of the array and is also electrically connected to a second group of at least two adjacent antenna elements adjacent the other end of the array. Individual phase shifters are connected to individual middle antenna elements for at least several of the antenna elements between the first and second groups of antenna elements. A switch selectively electrically connects a phase delay line in series between the phase shifter and the second group of antenna array elements to effectively double the number of good beam positions of the antenna array.

12 Claims, 1 Drawing Sheet

MICROWAVE ANTENNA SYSTEM

BACKGROUND OF THE INVENTION

I. Field of the Invention

The present invention relates generally to antennas and, more particularly, to a microwave antenna system.

II. Description of Related Art

A phased array antenna is oftentimes used to electronically scan a radar or microwave beam echo. Such microwave antenna systems are used in many different applications, including automotive applications.

These previously known phased array microwave antenna systems typically include a number of antenna elements that are linearly arranged from one end and to the other end and in which the antenna elements are equidistantly spaced from each other. In order to control the direction of the antenna scan, phase shifters are employed to modify the phase of the incoming received signals so that the signals combine in the desired direction of the antenna system.

One approach for controlling the phase shift in the antenna array elements is to provide a phase shifter for every single element in the array. Such a design gives near ideal performance to control the direction of the radar beam.

A disadvantage, however, of providing a phase shifter for every element in a phased array antenna system is that the phase shifters are relatively expensive and increase the complexity of the radar transceiver module. Consequently, providing a phase shifter for every element in the array dramatically increases not only the cost, but also the size, of the transceiver module for the radar system. In many types of systems, for example automotive systems, it is difficult to justify the cost of individual phase shifters for every array element.

In one prior design, a single phase shifter was connected to each pair of adjacent antenna elements thus effectively reducing the number of required phase shifters for the antenna system by one half. This approach, however, disadvantageously resulted in the generation of grating lobes for the received microwave signal. Such grating lobes cause targets outside the field of view to appear as if they are actually inside the field of view and are known as ghost targets. These ghost targets cannot be distinguished from the real target and, as a result, the scannable area of the phased array is reduced.

SUMMARY OF THE PRESENT INVENTION

The present invention provides a microwave antenna system which overcomes the above-mentioned disadvantages of the previously known antenna systems.

In brief, the microwave antenna system of the present invention comprises a phased array having a plurality of antenna elements linearly arranged from one end and to a second end. A phase shifter is electrically connected to a first group of at least two, and preferably more, antenna elements at one end of the array to control the signal phase of that group. The phase shifter is also electrically connected to a second group of antenna elements adjacent the other end of the antenna array.

In the design of microwave antenna systems, the phase shift between adjacent antenna elements, or group of elements, remains constant for proper steering of the antenna array. Consequently, for a certain finite number of positions, the phase shift at one end of the antenna array is offset from the other end of the antenna array by 360 degrees. Since 360 degrees is electrically the equivalent of 0 degrees, such a phase shift would be considered a "good" position in which the received signal is free of unacceptable grating lobes. Conversely, at other finite phase shift positions between adjacent elements, the phase of the first element is offset by 180 degrees from the desired phase shift at the opposite end of the antenna array. Such a condition will result in unacceptable grating lobes and ghost images.

Consequently, by using a single phase shifter to control the phase shift in two groups of antenna elements either at or adjacent the opposite ends of the antenna array, the number of phase shifters is effectively reduced but with the limitation that there are only a number of the phase shifts between adjacent elements which produce a 360 degree phase shift between the groups at the opposite ends of the antenna array and a like number of phase shifts between adjacent antenna elements that produce an unacceptable 180 degrees out of phase condition between the two groups of antenna elements.

In order to effectively double the number of good beam positions, a 180 degree phase line is selectively electrically connected in series between the phase shifter and the second group of antenna elements. Consequently, when the phase difference between the first and second groups would otherwise be 180 degrees out of phase, by electrically connecting the delay line in series between the phase shifter and the second group of antenna elements, the desired phase shift between the first and second groups of antenna elements is restored thus producing a good beam position.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
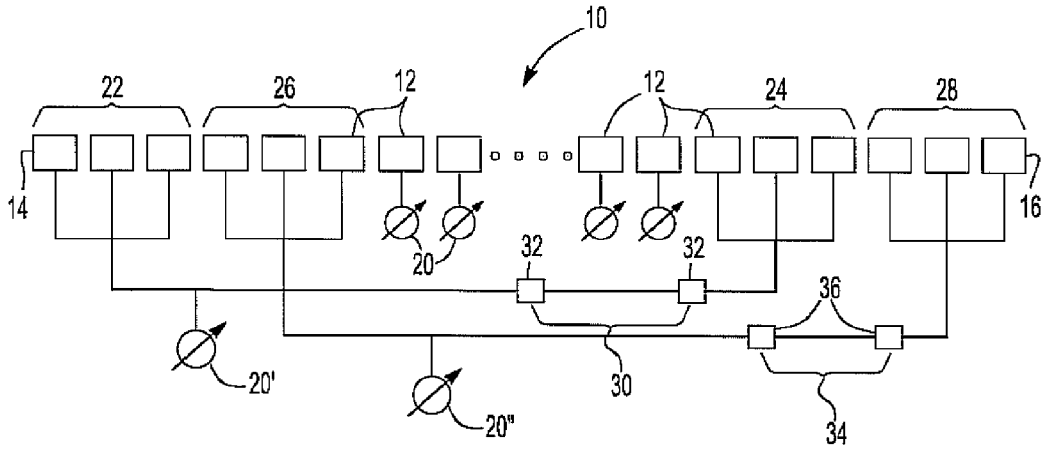
FIG. 1 is a block diagrammatic view illustrating a preferred embodiment of the present invention.

With reference first to FIG. 1, a diagrammatic view of a preferred embodiment of a microwave antenna system 10 is shown. The antenna system 10 includes a plurality of antenna elements 12 that are linearly arranged in an array from one end 14 and to a second end 16 of the array. The antenna elements 12, furthermore, are substantially identical to each other and are equidistantly spaced apart from each other.

The actual number of antenna elements 12 in the antenna array will vary from one antenna system and to the next. Increasing the number of antenna elements 12 increases the accuracy of the antenna direction and vice versa.

In order to control the beam direction, a plurality of phase shifters 20 are associated with the microwave antenna 10 to control the signal phase of the various antenna elements 12. It is desirable to minimize the number of phase shifters 20 used due to their high cost and added overall system complexity, while still maintaining acceptable antenna performance.

Unlike the previously known microwave antenna systems, a single phase shifter 20' is used to control the phase in a first group 22 of at least two and preferably three antenna elements 12 at the end 14 of the antenna array. That phase shifter 20' is also electrically connected to a second group 24 of at least two, and preferably three, antenna elements 12 adjacent, but spaced inwardly from, the other end 16 of the antenna array. Similarly, a second phase shifter 20" is electrically connected to a third group 26 of at least two, and preferably three, antenna array elements adjacent to the first group 22. This phase shifter 20" is also electrically connected to a fourth group 28 of at least two, and preferably three, antenna elements at the opposite end 16 of the antenna array.

Individual phase shifters 20 control the phase shift of the antenna elements 12 in between the third group 26 and second group 24 of array elements. Depending upon the number of antenna elements 12 in the antenna array, the phase offset between the first group 22 and second group 24 of antenna elements will be 360 degrees.

For example, assuming that there 22 antenna elements 12 in between the second group 24 and third group 26 of array elements, a 6 degree phase shift between adjacent elements or groups of elements will result in a phase shift of 360 degrees between the first group 22 and second group 24 of the antenna elements 12. The same is true for the phase shift between the third group 26 and fourth group 28 of antenna elements 12. As such, a phase shift of 6 degrees results in a good beam position. However, the next good beam position in which the phase shift between the first group 22 and second group 24 of antenna elements 12 will not occur until there is a 12 degree phase shift between the adjacent antenna elements or group of elements. A good beam position which occurs only every 6 degrees of phase shift provides only very coarse resolution which is unacceptable for many applications, including automotive radar applications.

In order to effectively double the number of good beam positions and thus double the resolution for the antenna array, a first 180 degree delay line 30 is selectively connected in series by switches 32 between the phase shifter 20' and the second group 24 of antenna elements 12. Any conventional switch 32, illustrated only diagrammatically, may be utilized to effectively switch the delay line 30 into and out of a series connection between the phase shifter 20' and the second group 24 of array elements 12.

Similarly, a second 180 degree delay line 34 is selectively connected by switches 36 in series between the phase shifter 20" and the fourth group 28 of array elements 12. Thus, when the delay line 34 is electrically connected in series between the phase shifter 20 and the fourth group 28 of array elements 12, the signal from the phase shifter 20 is effectively shifted by 180 degrees.

By selectively connecting the delay lines 30 and 34 between their associated phase shifter and their associated group 24 or 28 of array elements 12, the number of good beam positions is effectively doubled. For example, for the example previously given in which 22 individual array elements 12 are positioned in between the second and third groups 22 and 26 of the array elements 12, a 3 degree beam position without the delay lines 30 and 34 would result in a 180 degree phase shift between the first and second groups 22 and 24 as well as the third and fourth groups 26 and 28 of the array elements 12. Such a 180 degree phase difference would produce unacceptable grating lobes.

However, by switching the delay lines 30 and 34 so that they are connected in series between their associated phase shifter 20' or 20" and their associated group of antenna elements 12, the phase of the second and fourth groups 24 and 28 again matches the phase of the first and third groups 22 and 26, respectively, of antenna elements 12 thus providing a good beam position. In this way, a good beam position is achieved at every 3 degree increment of the phase shift between the adjacent antenna elements 12 or groups of elements. Such a 3 degree spacing provides sufficient resolution for many applications, including automotive applications.

Figure 2A:
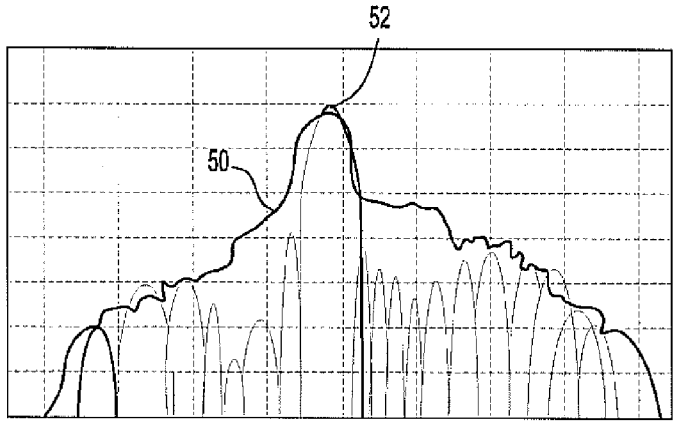
FIGS. 2A and 2B are graphical depictions illustrating the effect of the delay lines.
Figure 2B:
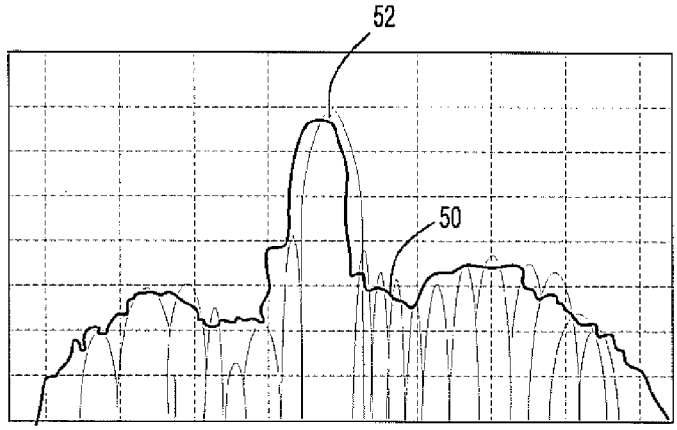

With reference now to FIGS. 2A and 2B, the effect of the delay lines 30 and 34 is there shown. FIG. 2A illustrates a graph of the received signal without the delay lines 30 and 34 at a beam positioned halfway in between two good beam positions, e.g. 3 degrees. As can be seen from FIG. 2A, high amplitude grating lobes 50 surround the main signal 52 which can cause ghosting of the received image.

Conversely, with the delay lines 30 and 34 coupled in series between their associated phase shifter 20' or 20" and their associated group 24 or 28 of the array elements 12, the received signal 52 is illustrated at a position halfway between a good beam position, e.g. 3 degrees. With the delay lines 30 and 34 creating a 180 degree phase shift of the signal between their antenna element 12 and phase shifters 20' or 20", the grating lobes 50 are greatly reduced in amplitude so that the desired signal 52 may be clearly distinguished from the grating lobes 50.

From the foregoing, it can be seen that the present invention provides a simple and yet effective microwave antenna system which not only reduces the number of phase shifters but also increases the number of good beam positions through the use of inexpensive delay lines and switches. Having described our invention, however, many modifications thereto will become apparent to those skilled in the art to which it pertains without deviation from the spirit of the invention as defined by the scope of the appended claims.

We claim:

1. A microwave antenna system comprising:

a plurality of antenna elements arranged in an array having two spaced ends, a first group of at least two adjacent antenna elements positioned at one end of said array and a second group of at least two adjacent antenna elements positioned adjacent the other end of said array, a group phase shifter having an output electrically connected to said first group of antenna elements to control the signal phase in said first group, said output of said group phase shifter being connected through a switch to said second group of antenna elements to control the signal phase in said second group of antenna elements, individual phase shifters connected to individual middle antenna elements for at least several of the antenna elements between said first and second groups of antenna elements to control the signal phase in said individual middle antenna elements, and a 180 degree phase delay line, wherein said switch selectively electrically connects said phase delay line in series between said phase shifter and said second group of at least two antenna elements.

2. The microwave antenna system as defined in claim 1 where said first and second groups each comprise at least three adjacent antenna elements.

3. The microwave antenna system as defined in claim 1 and comprising:

a third group of at least two adjacent antenna elements adjacent said first group and a fourth group of at least two adjacent antenna elements between the other end of said array and said second group, a second phase shifter controlling both said third and fourth groups of antenna elements, a second phase shifter controlling the signal phase in said third and fourth groups of antenna elements, a second phase delay line, and a second switch which selectively electrically connects said second phase delay line in series between said second phase shifter and said fourth group of at least two antenna elements.

4. The microwave antenna system as defined in claim 3 where said second phase delay line creates a 180 degree phase shift between its input and output.

5. The microwave antenna system as defined in claim 1 and comprising at least one amplifier to increase the signal magnitude of said middle antenna elements relative to said first and second groups of antenna elements.

6. The microwave antenna system as defined in claim 1 and comprising a plurality of signal amplifiers, one signal amplifier being operatively connected to each of at least several of said middle antenna elements.

7. A microwave antenna system comprising:

a plurality of antenna elements arranged in an array having two spaced ends, a phase shifter electrically connected to a first group of at least two adjacent antenna elements at one end of said array to control the signal phase in said first group and electrically connected to a second group of at least two adjacent antenna elements adjacent the other end of said array to control the signal phase in said second group, individual phase shifters connected to individual middle antenna elements for at least several of the antenna elements between said first and second groups of antenna elements to control the signal phase in said individual middle antenna elements, a phase delay line, a switch which selectively electrically connects said phase delay line in series between said phase shifter and said second group of at least two antenna elements, a third group of at least two adjacent antenna elements adjacent said first group and a fourth group of at least two adjacent antenna elements between the other end of said array and said second group, a second phase shifter controlling both said third and fourth groups of antenna elements, a second phase shifter controlling the signal phase in said third and fourth groups of antenna elements, a second phase delay line, and a second switch which selectively electrically connects said second phase delay line in series between said second phase shifter and said fourth group of at least two antenna elements.

8. The microwave antenna system as defined in claim 7 where said first and second groups each comprise at least three adjacent antenna elements.

9. The microwave antenna system as defined in claim 7 where said phase delay line creates a 180 degree phase shift between its input and output.

10. The microwave antenna system as defined in claim 7 where said second phase delay line creates a 180 degree phase shift between its input and output.

11. The microwave antenna system as defined in claim 7 and comprising at least one amplifier to increase the signal magnitude of said middle antenna elements relative to said first and second groups of antenna elements.

12. The microwave antenna system as defined in claim 7 and comprising a plurality of signal amplifiers, one signal amplifier being operatively connected to each of at least several of said middle antenna elements.

* * * * *